US009034181B1

(12) United States Patent
Robinson

(10) Patent No.: US 9,034,181 B1
(45) Date of Patent: May 19, 2015

(54) SWIMMING POOL NET

(71) Applicant: Robert Neil Robinson, St. Petersburg, FL (US)

(72) Inventor: Robert Neil Robinson, St. Petersburg, FL (US)

( * ) Notice: Subject to any disclaimer, the term of this patent is extended or adjusted under 35 U.S.C. 154(b) by 264 days.

(21) Appl. No.: 13/792,884

(22) Filed: Mar. 11, 2013

(51) Int. Cl.
*E04H 4/16* (2006.01)
*E04H 4/12* (2006.01)

(52) U.S. Cl.
CPC ..... *E04H 4/1209* (2013.01)

(58) Field of Classification Search
CPC ..... E04H 4/1209
USPC ..... 210/167.1, 167.19, 238, 470, 471, 408
See application file for complete search history.

(56) References Cited

U.S. PATENT DOCUMENTS

| | | | | | |
|---|---|---|---|---|---|
| 2,813,631 | A | * | 11/1957 | Odman | 210/359 |
| 4,106,157 | A | | 8/1978 | Baker | |
| 4,225,437 | A | | 9/1980 | Woodard | |
| 4,341,637 | A | * | 7/1982 | Smith | 210/662 |
| 4,846,972 | A | | 7/1989 | Anderson | |
| D316,619 | S | | 4/1991 | Richardson et al. | |
| 5,137,623 | A | | 8/1992 | Wall et al. | |
| 5,342,513 | A | | 8/1994 | Wall et al. | |
| 5,385,666 | A | | 1/1995 | Perlsweig | |
| 5,422,001 | A | | 6/1995 | Yagoda et al. | |
| 5,536,107 | A | | 7/1996 | Baker | |
| D381,781 | S | | 7/1997 | Clay | |
| 6,383,374 | B1 | | 5/2002 | Splendorio | |
| D460,625 | S | | 7/2002 | Wright | |
| 6,592,756 | B1 | | 7/2003 | Felix, Jr. et al. | |
| 7,232,523 | B2 | | 6/2007 | Clay | |
| 7,392,909 | B1 | | 7/2008 | Conrad | |
| 7,758,748 | B2 | | 7/2010 | Bogdanov et al. | |
| 2004/0108259 | A1 | | 6/2004 | Giannantonio | |
| 2006/0002759 | A1 | | 1/2006 | Blackman et al. | |

* cited by examiner

*Primary Examiner* — Fred Prince
(74) *Attorney, Agent, or Firm* — Nicholas Pfeifer; Ronald E. Smith; Smith & Hopen, P.A.

(57) ABSTRACT

A swimming pool net includes a mesh material and a frame that circumscribes the mesh. Fasteners are positioned in the frame to secure the mesh to the frame. A pair of mounts is formed in the frame in opposed relation to one another. A spring has opposed ends that respectively engage the opposed mounts. The spring is taut when its opposite ends engage the mounts. A middle section of the spring is manually pulled and spaced apart from the mesh by a preselected distance, followed by abrupt release of the spring, causing the middle section to travel from a first side of the frame to a second side, striking the mesh as the spring passes through the plane of the frame and ejecting items away from the mesh. The mounts may be apertures or posts or the ends of the spring may be embedded in the frame.

18 Claims, 6 Drawing Sheets

SWIMMING POOL NET

BACKGROUND OF THE INVENTION

1. Field of the Invention

This invention relates, generally, to nets of the type used to remove leaves and other debris from swimming pools or other bodies of water. More particularly, it relates to a structure that facilitates emptying of the net after each collection of leaves and other items.

2. Description of the Prior Art

Swimming pool nets are releasably attachable to the end of elongate poles so that a user standing on a pool deck can reach across a swimming pool or to the bottom of the pool if needed to remove leaves or miscellaneous debris from the pool. Standard practice is to lift the net from the pool when the net is full or partially full of leaves, branches, or other debris, and to invert the net and shake it to cause the debris to fall therefrom after the net has been moved to a location away from the pool. If all of the debris does not fall from the net when it is shaken, the frame of the net can be tapped or struck against a wall or other immovable object in order to bump or dislodge the debris from the net.

Most of the larger, heavier objects will fall from the net when the net is inverted but many smaller objects can stick to the net even when the net is shaken, tapped, or both. Large wet leaves can remain stuck to the net as well. The objects that remain adhered to the net are returned to the pool when the net is returned to the pool. Those objects have to be removed a second time, or a third time, or more, from the pool. With continued usage, the debris accumulation on the net can become unacceptable.

Thus there is a need for a net that can be cleaned of virtually all debris before the net is returned to the pool for further debris removal.

However, in view of the art considered as a whole at the time the present invention was made, it was not obvious to those of ordinary skill in the art how the needed structure could be provided.

SUMMARY OF THE INVENTION

The long-standing but heretofore unfulfilled need for a swimming pool net that facilitates release of collected debris therefrom is now met by a new, useful, and non-obvious invention.

In a first embodiment, the novel structure includes a mesh material forming a net, a frame that circumscribes the mesh, and a plurality of fasteners positioned about the frame that secures the mesh at its peripheral edges to the frame.

The frame for most swimming pool nets has a rectangular cross section including a flat top surface, a flat bottom surface, and a flat sidewall that extends between the flat top and bottom surfaces.

The frame and the mesh share a common longitudinal axis of symmetry with an elongate, telescoping handle to which the frame is releasably attached in a well-known way. More particularly, the telescoping handle releasably engages a truncate rigid handle that engages the rigid frame. The truncate rigid handle also shares a longitudinal axis of symmetry with the frame, the mesh, and the telescoping handle.

In the first embodiment, a novel pair of apertures is preferably formed in the rigid frame about mid-length thereof. Each aperture of the pair of apertures is opposed to the other aperture relative to the longitudinal axis of symmetry of the frame and net structure.

In the first embodiment, the apertures are formed in the flat bottom surface of the frame.

In a second embodiment, the apertures are formed in the sidewall of the frame on an exterior side thereof, i.e., the side facing away from the mesh.

In both embodiments, an elongate spring or other suitable bias means has opposed ends that are secured within the apertures and the length of the bias means is chosen so that it is taut when its opposite ends are so secured.

In the first embodiment, the opposite ends of the spring or other suitable bias means are disposed in engaging relation to respective apertures formed in the opposing flat bottom surfaces of the frame. The apertures may be transversely opposed to one another, i.e., on opposite sides of the longitudinal axis of the frame or they may be longitudinally opposed to one another, i.e., on opposite sides of the transverse axis of the frame. There is no requirement that the apertures be directly opposed to one another.

In the second embodiment, the opposite ends of the spring or other suitable bias means are disposed in engaging relation to the respective apertures formed in the exterior surface of the side walls.

In both embodiments, the user orients the mesh so that the spring/bias means underlies the mesh when the net is used to collect debris from a swimming pool or other body of water.

After debris has been collected in the well-known way, the net is removed from the water and moved to a location where the debris is to be removed from the net. The net is oriented in a generally vertical plane, causing most of the easy-to-remove debris to fall from the net but leaving the more difficult-to-remove debris, including particles, clinging to the mesh. The net can also be completely inverted in order to accomplish debris separation from the net.

With the net preferably in its inverted position, or perhaps held in a vertical plane, the spring/bias means is manually grasped about mid-length thereof with a first hand and pulled away from the plane of the frame and hence away from the mesh by a preselected distance such as several inches while the handle is held in a second hand. The distance between the first and second hands is increased as the spring is pulled back, i.e., the first hand may draw the spring back while the handle is held against movement by the second hand, or the first hand that grasps the spring can be held against movement while the handle-holding hand is displaced away from the first hand, or both. The distance between the two hands of the user is a function of the initial tautness of the spring, other inherent properties of the spring, and the amount of force exerted by the user.

The spring is then abruptly released, causing the middle section of the spring to travel from a first side of the plane of the frame to a second side of the plane, striking the mesh as the spring passes through the plane and ejecting items clinging to the mesh away from the mesh.

In a third embodiment, the mesh is covered with a coat of silicone or equivalent material to reduce the clinging force and hence to reduce the amount of force that must be imparted to the mesh by the released spring.

In a variation of the third embodiment, the mesh is made of silicone or equivalent material so no coating is required.

In a fourth embodiment, the spring or other suitable bias means is eliminated and the net is coated with silicone or similar material so that debris does not stick thereto when the net is emptied by inverting, shaking, striking, or combinations thereof.

In a variation of the fourth embodiment, the mesh is made of silicone or equivalent material so no coating is required.

In a fifth embodiment, not depicted, the apertures of the first embodiment are replaced by posts and the opposite ends of the bias means engage the posts.

In a sixth embodiment, not depicted, the apertures of the second embodiment are replaced by posts and the opposite ends of the bias means engage the posts.

In a seventh embodiment, not depicted, the opposite ends of the bias means are embedded within the frame so that neither the apertures nor the posts are needed.

Thus it is understood that there is no requirement that the opposite ends of the bias means be attached to the frame of the net with apertures or posts or any particular mounting means.

An eighth embodiment is used with a bag net and employs no independent bias means. The mesh material is made of a stretchable, resilient, flexible, elastomeric material and a mesh-engaging handle is secured to the center of the bag net on an external surface thereof. The user grasps the mesh-engaging handle with a first hand and holds the frame-engaging handle in a second hand. The distance between the first and second hands is increased as the mesh-engaging handle is pulled back, i.e., the first hand may draw the mesh-engaging handle away from the rigid frame while the frame-engaging handle is held against movement by the second hand, or the first hand that grasps the mesh-engaging handle can be held against movement while the rigid frame handle-holding hand is displaced away from the first hand, or both.

A ninth embodiment, like the eighth embodiment, is used with a bag net but differs from the eighth embodiment in that it does employ an independent bias means such as, but not limited to, an elongate flaccid rubber band having its mid-point attached in the center of an elastic or non-elastic bag net by means of the mesh-engaging handle. The opposite ends of such rubber band, or other suitable bias means, would be secured to the frame as in several of the other embodiments. This combines the inherent elasticity of the mesh material with the elasticity of the rubber band, both of which combine to enhance the discharge of debris.

The mesh-engaging handle is abruptly released, causing the mesh-engaging handle and hence the center of the net to travel from a first side of the plane of the rigid frame to a second side of the plane and ejecting items clinging to the mesh away from the mesh. The net is turned inside out when the items are ejected from the net.

The primary object of this invention is to improve swimming pool nets in order to facilitate debris removal from pools, water fountains, and the like.

A more specific object is to accomplish the foregoing object in a way that does not add appreciable cost to a swimming pool net.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
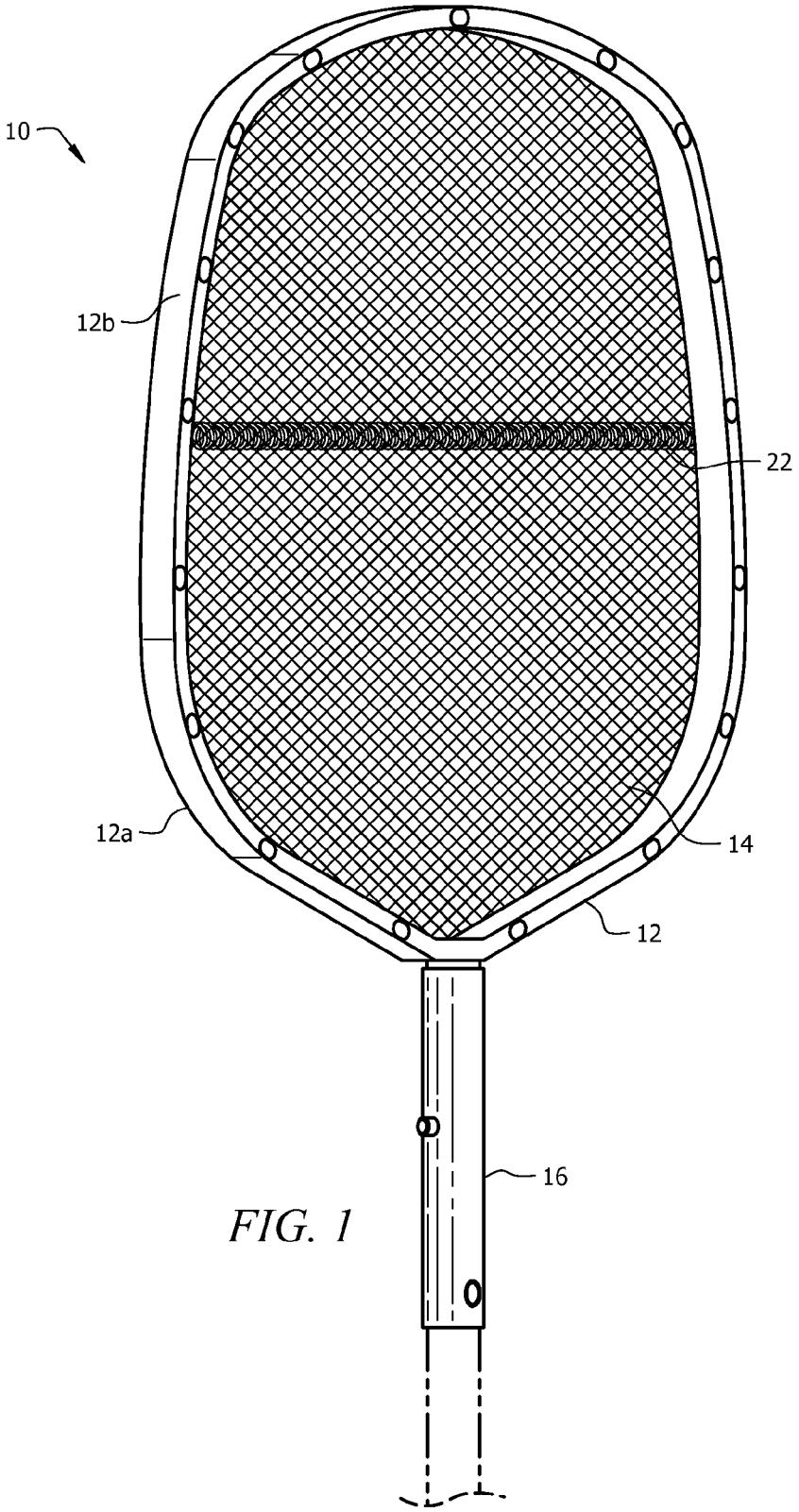
FIG. 1 is a top perspective view of a first embodiment of the novel structure.

FIG. 1 depicts an illustrative embodiment of the novel structure which is denoted as a whole by the reference numeral 10.

Swimming pool net 10 is of conventional construction and includes substantially rigid frame 12, mesh 14, and handle 16 which releasably engages an elongate pole that is depicted in phantom lines in FIG. 1. This type of net is shallow in depth relative to a bag net.

Frame 12 preferably has a rectangular cross-section including a flat top surface, a flat bottom surface, an interior sidewall and an exterior sidewall. However, frame 12 may have a cross-section of any predetermined geometric configuration.

Figure 2:
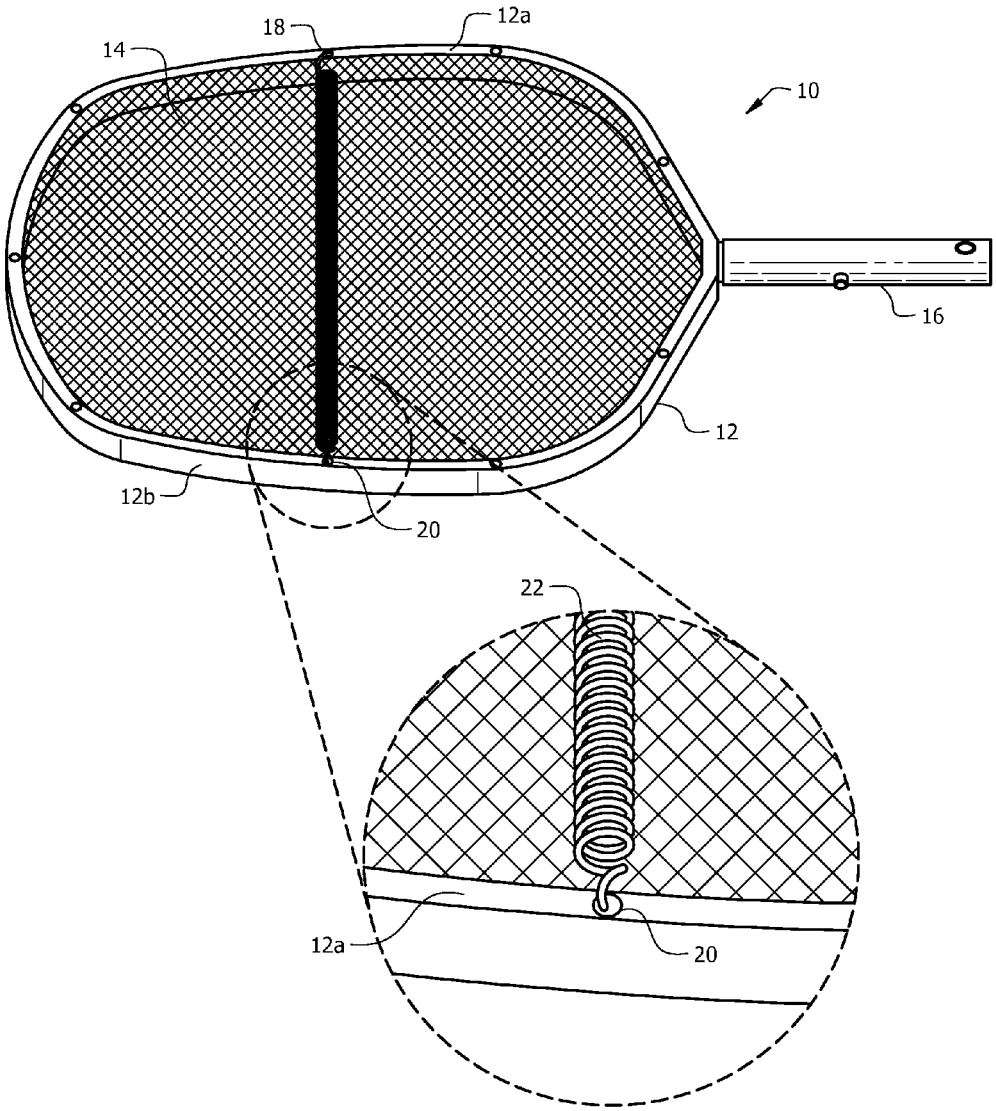
FIG. 2 is a bottom perspective view of the first embodiment, and includes an enlarged view to better depict how the novel spring engages the frame of the net at a bottom wall of the frame.

Novel apertures 18, 20 are formed in flat bottom surface 12*a* of frame 12 in opposed relation to one another and said apertures receive opposite ends of spring 22, or other suitable bias means, as depicted in FIG. 2. Although the apertures are illustrated as being transversely opposed to one another, no precise transverse or longitudinal alignment is required as mentioned above.

Spring 22 is under tension when its opposite ends are positioned in said apertures 18, 20. Accordingly, spring 22 is straight when in repose and lies in a plane that is parallel and closely spaced to the mesh and to the plane defined by frame 12. Bias means 22 is preferably mounted on the side of the frame that enables it to be closest to the mesh material.

There is no requirement that apertures 18, 20 be disposed in precise transverse alignment with one another. Spring 22 may extend diagonally or longitudinally across mesh 14 and not just straight across as depicted in this disclosure of the preferred embodiment.

Figure 3A:
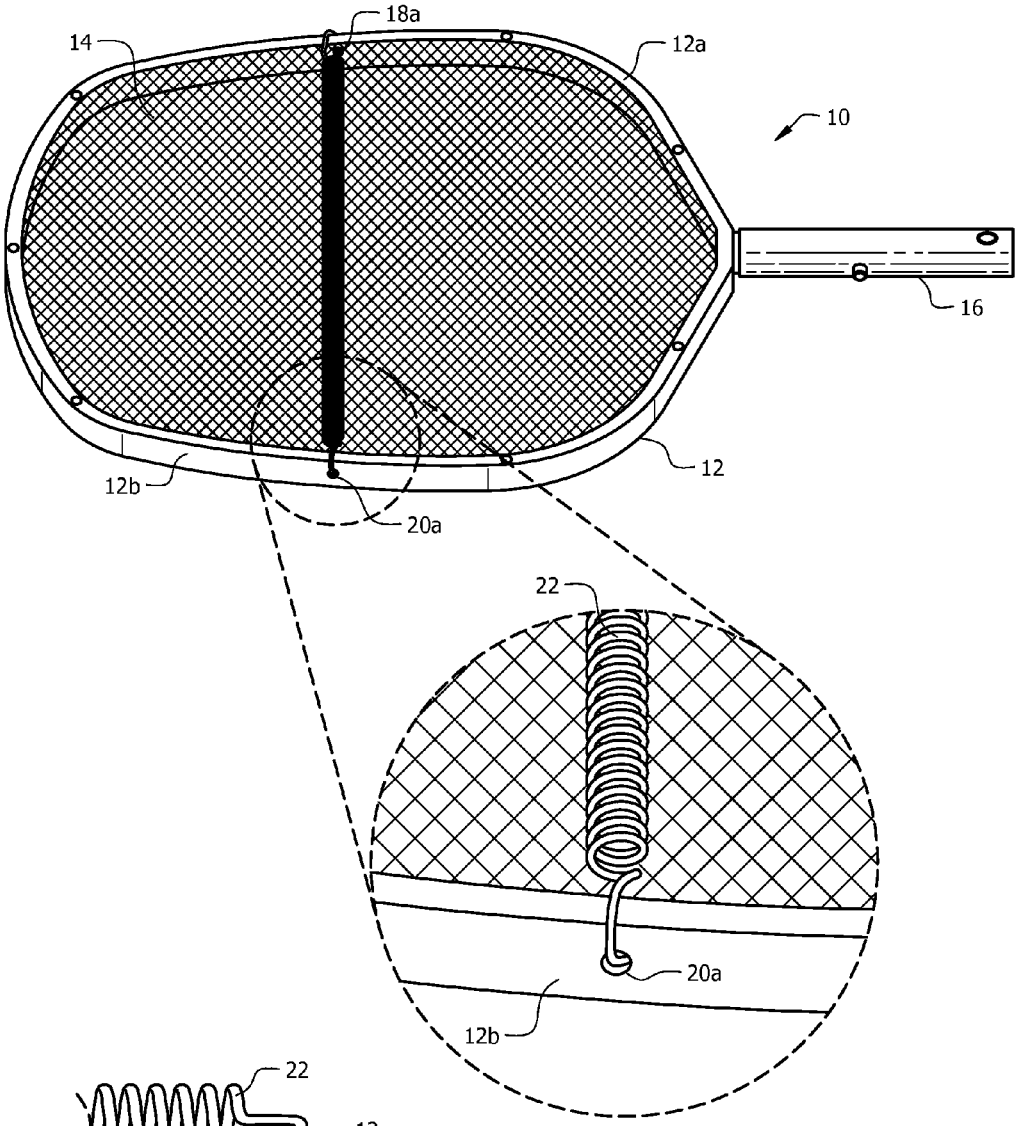
FIG. 3A is a bottom perspective view of the second embodiment and includes an enlarged view to better depict how the novel spring engages the frame of the net at a side wall of the frame.
Figure 3B:
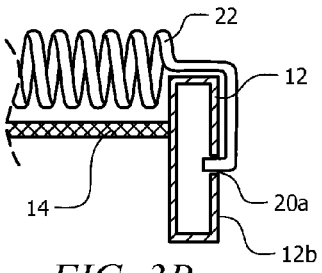
FIG. 3B is an enlarged view depicting a ninety degree bend formed in the second embodiment of the spring to facilitate the engagement of the frame sidewall.

FIGS. 3A and 3B depict a second embodiment where the opposite ends of spring 22 are positioned within opposing apertures 18*a*, 20*a* formed in exterior sidewalls 12*b*, 12*b* of frame 12. This position of the spring provides a mechanically more robust mounting of the spring.

Figures 4A, 4B:
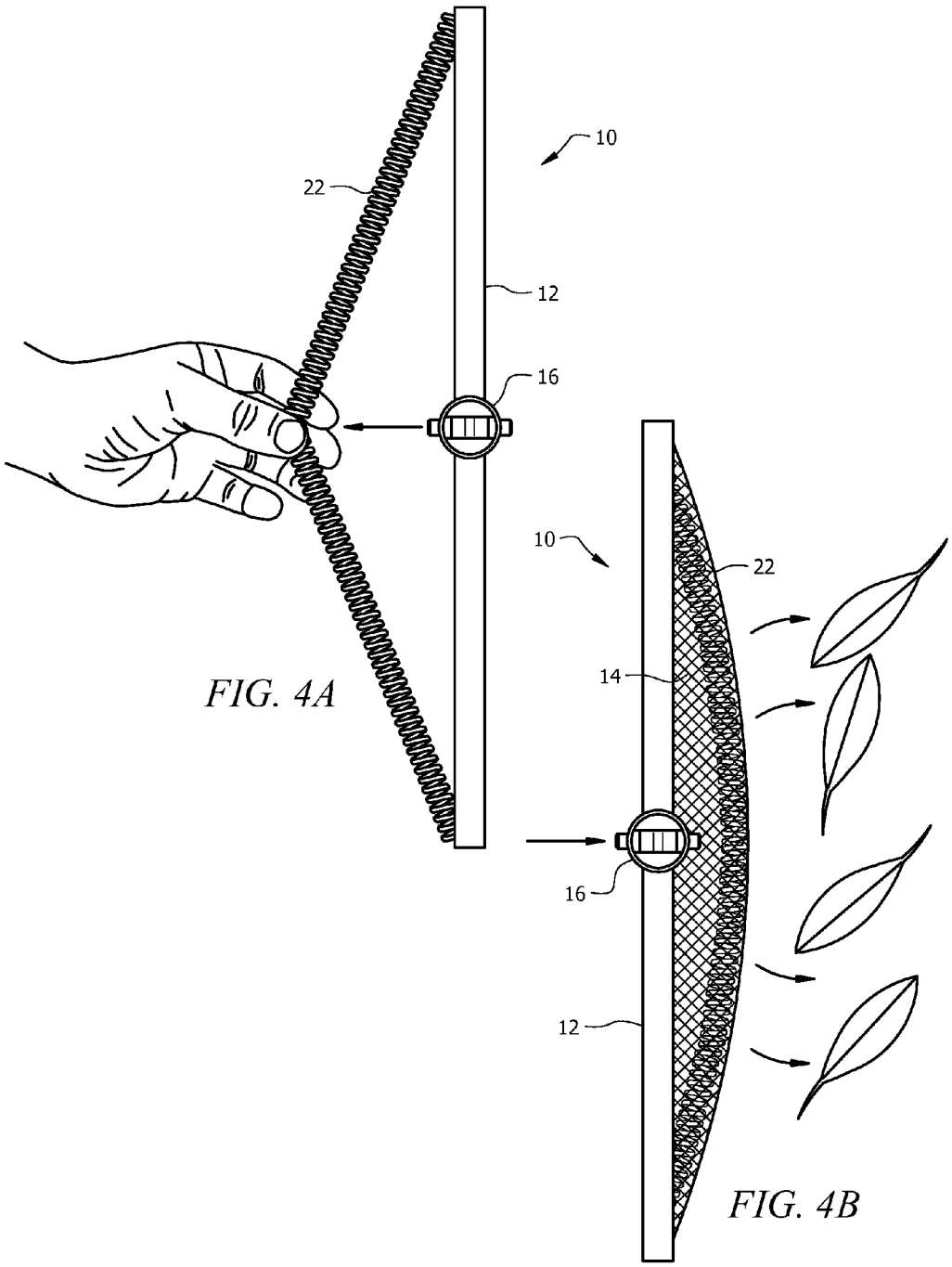
FIG. 4A is an end elevational view depicting the spring when pulled from the net by a user.
FIG. 4B is an end elevational view depicting the spring position after the spring is released from its FIG. 4A position.

FIG. 4A depicts spring 22 when it is displaced from its position of repose by a user who has grasped said spring about mid-length thereof, and has pulled the middle of the spring away from its position of repose by a few inches.

Spring 22 when released travels at a high rate of speed. FIG. 4B depicts spring 22 after it has been released from its FIG. 4A position. It collides with mesh 14 and momentarily displaces it as depicted in said FIG. 4B. When released, spring 22 travels through its position of repose to a point on the opposite side of the frame from its position when grasped by a user. The contact between spring and mesh is abrupt so the force that unloads the spring upon release is abruptly transferred to the mesh. The momentum thus imparted to the mesh throws the debris in said net away from said net in the same direction of travel of spring 22. The force of the impact is sufficient to dislodge even small and light particles of debris so that the mesh is virtually perfectly clean when it is returned to the pool for further debris removal.

The preferred spring is a coil or extension spring formed of stainless steel. However, the scope of this invention includes any suitable bias means capable of spanning the frame when in repose, capable of being pulled manually away from said position of repose, and capable of abruptly returning to its position of repose upon release, passing through the plane of the frame before returning to said position of repose. Such bias means could include at least one rubber band, at least one bungee cord, or the like.

It has also been discovered that application of a coat of silicone to mesh 14 enhances the performance of the novel bias means. Thus, the structure of either the first or the second embodiment may be enhanced by coating the mesh with a layer of silicone or suitable substitute and such construction is the third embodiment of this invention. In a variation of the third embodiment, the net itself is formed of silicone or other suitable material.

In a fourth embodiment, not illustrated, no bias means is employed. The surface tension of water is reduced by coating the mesh material with silicone, Teflon, or other surface-tension-reducing material. The net is still at least partially inverted and shaken or struck, or both, in order to accomplish debris separation from the mesh material. In a variation of the fourth embodiment, the net itself is formed of silicone or other suitable material.

In a fifth embodiment, not illustrated, the apertures of the first embodiment are respectively replaced with rigid posts of truncate extent that are formed integrally with the frame and which project therefrom. The opposing ends of the spring or other bias means thus engage projecting posts instead of recessed apertures.

In a sixth embodiment, not illustrated, the apertures of the second embodiment are respectively replaced with rigid posts of truncate extent that are formed integrally with the frame and which project therefrom. The opposing ends of the spring or other bias means thus engage projecting posts instead of recessed apertures.

In an undepicted seventh embodiment, neither apertures nor posts are used to anchor opposite ends of the bias means. The opposite ends are instead embedded within the frame at the time of frame manufacture.

Any suitable mounting means to which the opposite ends of the spring may be attached is within the scope of this invention.

The novel structure works well with flat or nearly flat nets but it also has utility in connection with bag nets.

Figure 5:
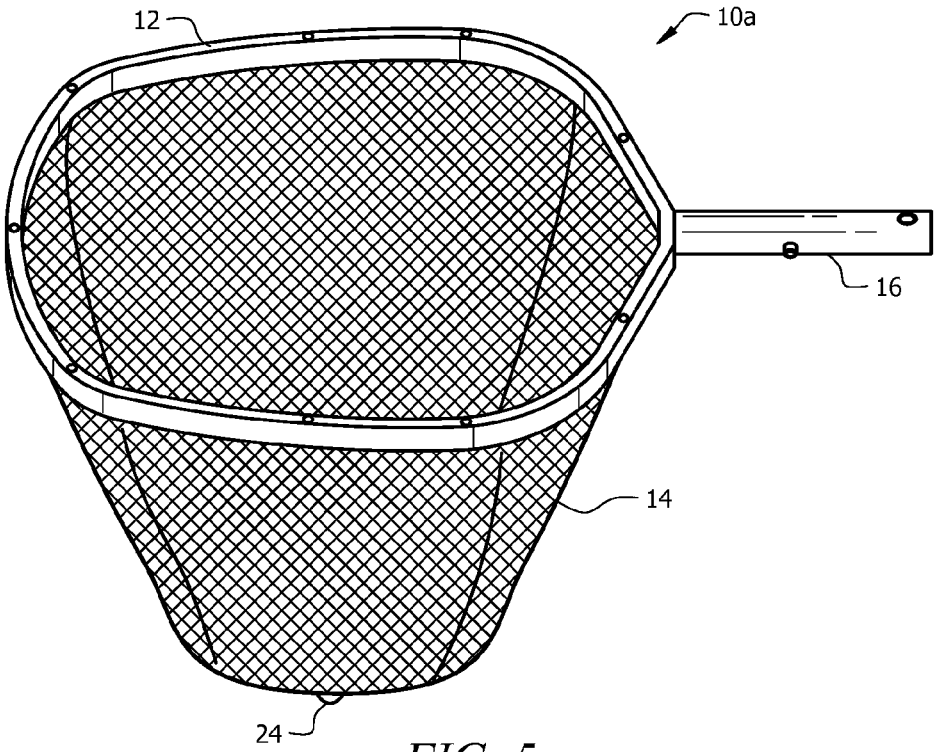
FIG. 5 is a perspective view of an embodiment where the net is formed of an elastomeric material.
Figure 6A:
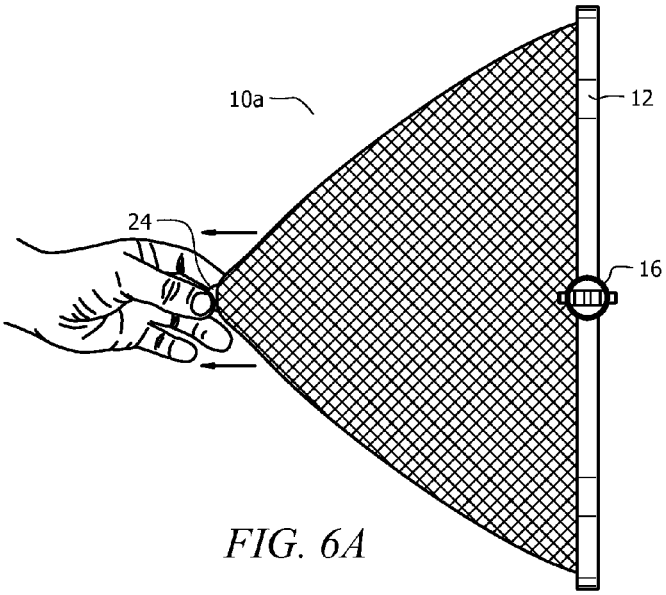
FIG. 6A depicts a user causing the elastomeric material to be stretched away from its position of repose by manipulation of a mesh-engaging handle.
Figure 6B:
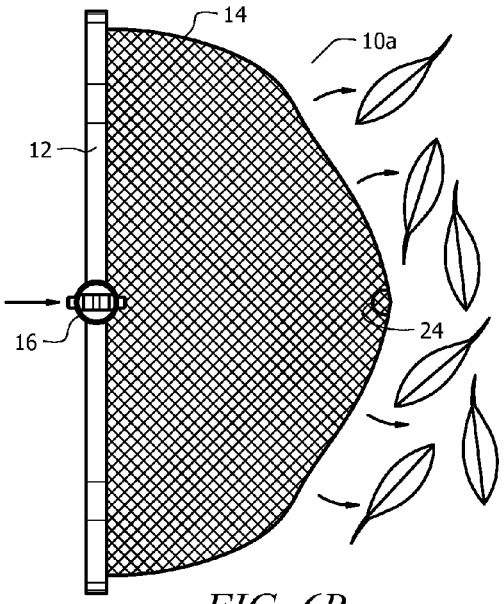
FIG. 6B depicts a position of the elastomeric net after the mesh-engaging handle has been released.

An eighth embodiment, having utility in connection with bag nets and denoted 10*a* as a whole, is depicted in FIGS. 5, 6A and 6B. Each strand of mesh 14 that collectively forms the net is formed of an elastomeric material so that it may be stretched without breaking. Mesh-engaging handle 24 is attached to the outside of the net at its center as depicted in FIGS. 5, 6A and 6B.

In this particular embodiment, mesh-engaging handle 24 is marble-shaped and sized for convenience but any mesh-engaging means that can be grasped and released easily by a user is within the scope of this invention. Handle 24 can be secured to mesh 14 by adhesive means. Handle 24 could also be molded around the mesh at the center of the bag net or stitched to said center as well. Any means for attaching handle 24 to mesh 14 is within the scope of this invention.

A user holds pole-engaging handle 16 to which rigid frame 12 is attached in one hand while drawing mesh-engaging handle 24 back, much like an archer drawing back a bowstring, or the elastic sling of a slingshot, with the other hand. As depicted in FIG. 6A, handle 16 is held in a right hand while a left hand draws back mesh-engaging handle 24.

Mesh-engaging handle 24 is drawn back a distance sufficient to apply a substantial stress on net 14 and mesh-engaging handle 24 is then abruptly released, much like an arrow, so that mesh-engaging handle 24 is shot through the middle of frame 12. As depicted in FIG. 6B, debris is knocked from the net substantially at the moment mesh-engaging handle 24 ends its forward travel and begins its rearward travel. The net at that moment is fully turned inside/out vis a vis its FIG. 6A position. As drawn, net 14 has not yet reached its forwardmost point of travel as indicated by the undulations in the net that are still visible.

A ninth embodiment, not depicted, includes the structure of the eighth embodiment and adds an independent bias means such as, but not limited to, an elongate flaccid rubber band having its mid-point attached in the center of an elastic or non-elastic bag net by means of the mesh-engaging handle. The opposite ends of such rubber band, or other suitable bias means, are secured to the frame as in several of the other embodiments. This combines the inherent elasticity of the mesh material with the elasticity of the rubber band, both of which combine to enhance the discharge of debris.

It will also be understood that the flat or relatively flat net of the first-disclosed embodiments may also be made of an elastomeric material and provided with a mesh engaging handle, thereby obviating the need for a spring or other bias means.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A net for removing debris from a body of water, comprising:

a mesh material forming a net;

a rigid frame that circumscribes a periphery of said net;

a plurality of fasteners positioned in said frame that secures said mesh at its peripheral edges to said frame;

a handle secured to said rigid frame;

said frame, said mesh, and said handle sharing a common longitudinal axis of symmetry;

a pair of mounts formed in said frame, each mount of said pair of mounts being opposed to the other mount relative to said longitudinal axis of symmetry;

an elongate bias means having opposed ends, a first end disposed in engaging relation to a first mount of said pair of mounts and a second end disposed in engaging relation to a second mount of said pair of mounts;

said elongate bias means having a length preselected so that said bias means is taut when its opposite ends engage said first and second mounts, respectively;

said bias means being parallel to a plane of said frame when said opposite ends of said bias means engage said apertures;

said bias means being in closely spaced relation to said mesh when said opposite ends of said bias means engage said mounts;

whereby holding said rigid handle in a first hand and manual pulling of said bias means about mid-length of said bias means with a second hand so that a middle section of said bias means is spaced apart from the net by a preselected distance, followed by abrupt release of said bias means, causes said middle section of said bias means to travel from a first side of said plane of said frame to a second side of said plane, striking said mesh as said bias means passes through the plane of said frame and ejecting items resting against said mesh away from said mesh.

2. The net of claim 1, further comprising:

each mount of said pair of mounts being an aperture formed in said frame.

3. The net of claim 1, further comprising:

each mount of said pair of mounts being an upstanding rigid post formed in said frame.

4. The net of claim 1, further comprising:

said frame being a wall having a rectangular cross-section and which includes a flat top surface, a flat bottom surface, an interior sidewall and an exterior sidewall.

5. The net of claim 4, further comprising:

said pair of mounts being formed in said flat bottom surface of said wall.

6. The net of claim 4, further comprising:

said pair of mounts being formed in said wall on said exterior sidewall thereof.

7. The net of claim 1, further comprising:

said mesh being covered with a coat of silicone.

8. The net of claim 1, further comprising:

said mesh being made of silicone.

9. A net for removing debris from a body of water, comprising:

a mesh material forming a net;

a frame that circumscribes said mesh;

a plurality of fasteners positioned in said frame that secures said mesh at its peripheral edges to said frame;

said net being coated with a material that reduces the surface tension of water so that debris separates from said mesh material when said net is at least partially inverted and shaken or struck.

10. The net of claim 9, further comprising:

said material being silicone.

11. A net for removing debris from a body of water, comprising:

a mesh material forming a net;

a frame that circumscribes said mesh;

a plurality of fasteners positioned in said frame that secures said mesh at its peripheral edges to said frame;

said net being made of a material that reduces the surface tension of water so that debris separates from said mesh material when said net is at least partially inverted and shaken or struck.

12. The net of claim 11, further comprising:

said material being silicone.

13. A net for removing debris from a body of water, comprising:

a mesh material forming a net;

a rigid frame that circumscribes said mesh material;

a plurality of fasteners positioned in said frame that secures said mesh at its peripheral edges to said frame;

a handle secured to said rigid frame;

said frame, said mesh, and said handle sharing a common longitudinal axis of symmetry;

said mesh being formed of an elastomeric material; and a mesh-engaging handle secured to said mesh at a center of said net;

whereby manual engagement of said mesh-engaging handle and manual engagement of said rigid frame-engaging handle and manual application of force to increase separation of said handles relative to one another causes said elastomeric net to stretch so that abrupt release of said mesh-engaging handle causes said mesh-engaging handle and hence the center of said net to travel from a first side of said plane of said frame to a second side of said plane, turning said bag net inside out and ejecting items from said net.

14. The net of claim 13, further comprising:

said net being a deep, bag-like net.

15. The net of claim 13, further comprising:

said net being a shallow net.

16. The net of claim 13, further comprising:

said net being coated with a material that reduces the surface tension of water.

17. The net of claim 13, further comprising:

said net being formed of a material that reduces the surface tension of water.

18. The net of claim 13, further comprising:

an independent, elongate bias means having its opposite ends secured to said frame and having its mid-point attached in the center of said net by means of said mesh-engaging handle.

* * * * *